US005926842A

United States Patent [19]

Price et al.

[11] Patent Number: 5,926,842

[45] **Date of Patent: *Jul. 27, 1999**

[54] BALLISTIC VEST

[75] Inventors: Allen L. Price, Rising Sun, Md.; Steven A. Young, Richmond, Va.

[73] Assignee: Safariland Ltd., Inc., Ontario, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/727,838

[22] Filed: Oct. 2, 1996

[51] Int. Cl.[6] ..... F41H 1/02

[52] U.S. Cl. ..... 2/2.5; 428/911

[58] Field of Search ..... 2/2.5, 455, 456, 2/463, 467; 428/911, 340; 442/246, 286, 390, 297, 298, 255, 269, 301, 333, 366

[56] References Cited

U.S. PATENT DOCUMENTS

| | | | |
|---|---|---|---|
| 3,582,988 | 6/1971 | Armellino | 2/2.5 |
| 3,924,038 | 12/1975 | McArdle et al. | 428/49 |
| 4,403,012 | 9/1983 | Harpell et al. | 428/290 |
| 4,413,357 | 11/1983 | Sacks | 2/2.5 |
| 4,457,985 | 7/1984 | Harpell et al. | 428/224 |
| 4,501,856 | 2/1985 | Harpell et al. | 525/240 |
| 4,623,574 | 11/1986 | Harpell et al. | 428/113 |
| 4,650,710 | 3/1987 | Harpell et al. | 428/263 |
| 4,660,223 | 4/1987 | Fritch | 2/2.5 |
| 4,681,792 | 7/1987 | Harpell et al. | 428/102 |
| 4,697,285 | 10/1987 | Sylvester | 2/2.5 |
| 4,879,165 | 11/1989 | Smith | 428/212 |
| 4,884,295 | 12/1989 | Cox | 2/2.5 |
| 4,989,266 | 2/1991 | Borgese et al. | 2/2.5 |
| 5,008,959 | 4/1991 | Coppage, Jr. et al. | 2/2.5 |
| 5,112,667 | 5/1992 | Li et al. | 428/113 |
| 5,185,195 | 2/1993 | Harpell et al. | 428/102 |
| 5,327,811 | 7/1994 | Price et al. | 89/36.05 |
| 5,395,671 | 3/1995 | Coppage, Jr. et al. | 428/102 |

FOREIGN PATENT DOCUMENTS

| | | |
|---|---|---|
| 2198628 | 6/1988 | United Kingdom . |
| 87/03674 | 6/1987 | WIPO . |

*Primary Examiner*—Michael A. Neas
*Assistant Examiner*—Larry D. Worrell, Jr.
*Attorney, Agent, or Firm*—Christie, Parker & Hale, LLP

[57] ABSTRACT

A ballistic vest of the soft body armor type comprises a plurality of overlying first flexible layers arranged in a stack on a strike side of the vest and a plurality of overlying second flexible layers arranged in a stack on a body side of the vest. One of the first or second flexible layers comprises unidirectional aramid fibers coated with resin and cross plied to form a flexible plastic sheet, and the other flexible layer comprises thin plastic ballistic fibers forming a thin flexible woven fabric sheet. The woven fabric sheet can consist of aramid fibers or non-aramid fibers.

13 Claims, 3 Drawing Sheets

BALLISTIC VEST

FIELD OF THE INVENTION

This invention relates to protective vests, and more particularly, to body armor commonly known as a ballistic vest which incorporates hybrid ballistic packages including aramid and non-aramid polymeric fibers.

BACKGROUND OF THE INVENTION

Ballistic vests have saved the lives of many law enforcement officers in recent years. As a result, many law enforcement agencies have made it mandatory for their officers to wear ballistic vests while on duty.

Ballistic vests have been available in recent years as a protective panel having overlying layers of a fabric made from woven high tensile strength ballistic resistant polymeric fibers. Woven fabrics made from an aramid fiber known as KEVLAR, for example, have been used successfully in ballistic vests because of the high energy absorption properties of the fabric material. The material is also reasonably light in weight and flexible, which provides improved comfort when compared with previous vests which are made of nylon and metal and were therefore heavier and more rigid.

The comfort of a ballistic vest is extremely important, especially to law enforcement officers, because of the heat build-up that occurs from wearing a heavy and inflexible vest for the long hours an officer is on duty. Resistance to projectile penetration is a principal factor in designing a ballistic vest; and added protective layers can offer great protection against projectiles having higher threat levels, but added protective layers also add undesired weight and inflexibility of the vest.

In addition to woven KEVLAR fabric layers, ballistic vests have been made from other high performance synthetic fibers and composites to reduce weight and improve flexibility. However, ballistic vests using the lighter, more flexible ballistic materials also must offer the required minimal levels of protection against penetration by different types of projectiles.

Ballistic vests are regularly certified by ballistics testing to measure their ability to protect against different projectiles fired from different types of weapons at various angles. One ballistic test commonly used in the industry is the National Institute of Justice (NIJ) Standards 0101.03 which, in general terms, is a high performance standard requiring that the ballistic vest prevent penetration of specified rounds fired at velocities up to 1450 ft/sec. In addition to preventing such projectile penetration, "backface deformation" also is a required test factor in the NIJ Standard 0101.03 certification test. Backface deformation indirectly measures the trauma level experienced by a user from a projectile that does not penetrate the test panel. According to this test, the maximum allowable backface signature (bfs) containment for soft body armor requires a maximum allowable bfs of all rounds.

There is a need to provide a ballistic vest that is reasonably thin and light in weight as compared to vests previously made, is highly flexible and comfortable, and is also capable of meeting the NIJ high performance projectile test specifications. Providing such a vest at a reasonably low cost for the comparable high performance level is also a desired objective.

At the present time most ballistic vests worn by law enforcement officers are designed to meet Threat Level IIIA, IIA, or II Standards. One objective is to produce a reasonably lightweight and flexible vest that can meet the rigorous requirements of Level IIIA certification testing. There are other instances where lighter weight vests are more desirable even though they may not meet the Threat Level IIIA Standards. Here the challenge is to produce a lightweight vest capable of meeting the certification standards of NIJ Threat Levels II and IIA. An extremely lightweight vest with an areal weight less than 1.25 pounds per square foot and, more preferably, less than one pound per square foot that meets Level II and IIA standards is particularly desirable.

SUMMARY OF THE INVENTION

The present invention provides a ballistic vest of the soft body armor type comprising a plurality of overlying flexible first ballistic layers arranged in a stack on a strike side of the vest, and a plurality of overlying flexible second ballistic layers arranged in a stack on a body side of the vest. An alternative embodiment includes a plurality of flexible third ballistic layers arranged in a stack and sandwiched with the first and second ballistic layers. One aspect of the invention is the use of unidirectional aramid fiber ballistic fabrics in hybrid ballistic packages in which the unidirectional aramid fiber ballistic fabrics are used in combination with woven aramid fiber ballistic fabrics and woven non-aramid polymeric fiber ballistic fabrics. The advantages of these combinations are improved ballistics data when the hybrid combination is used as compared with a ballistics combination of purely unidirectional aramid fibers and woven aramid fibers. Another advantage is that the hybrid ballistic packages provide a thinner more compact ballistic vest.

Each flexible first ballistic layer preferably comprises a thin, flexible, unidirectional aramid fiber sheet made of high tensile strength aramid fibers. The unidirectional aramid fibers are coated with resin and typically cross-plied at 90° to form a ballistic fabric comprising an aramid fiber-reinforced thermoplastic film sheet. The individual unidirectional aramid fiber film sheets overlie each other as a unit to form a soft, flexible aramid fiber ballistic panel for the vest. Each flexible second ballistic layer comprises a thin, flexible woven fabric layer made of high tensile strength polymeric ballistic fibers. The fibers for each second layer can be preferably aramid fibers or a less preferred non-aramid ballistic fiber such as polyethylene. The second woven fabric layers overlie each other and as a combination are referred to as a second panel of the vest. The stacks of first and second flexible layers are arranged in combinations providing ballistic resistance with reasonably low areal weight and good flexibility.

Alternatively, in constructions utilizing a plurality of third flexible layers, each third flexible layer comprises a thin, flexible layer of fibers which can be either unidirectional aramid fibers, woven aramid or woven non-aramid polymeric fibers depending upon the specific construction of the plurality of first and second layers. The specific fibers utilized for the third layers are such that the result is a hybrid combination of unidirectional aramid fibers and either woven aramid or non-aramid fibers.

The result of the invention is a ballistic vest which, in one embodiment, is reasonably thin and light in weight, highly flexible and comfortable, and designed to provide high performance Threat Level IIIA resistance to ballistic penetration and backface deformation. This combination of properties is in addition to reasonably low cost of the vest for the high performance level achieved.

In other embodiments of the invention, extremely lightweight ballistic vests are designed to meet NIJ Standard Threat Level II and IIA test specifications, while having an areal weight of less than 1.25 pounds per square foot, and more preferably, less than one pound per square foot.

An advantage of the invention is the lower cost of the aramid fiber-based ballistic fabric materials, compared with ballistic fabrics purely made of polyethylene fibers. Additional advantages include better capability of resisting penetration from steel jacketed rounds and better flame barrier properties.

These and other aspects of the invention will be more fully understood by referring to the following detailed description and the accompanying drawings.

DETAILED DESCRIPTION

Figure 1:
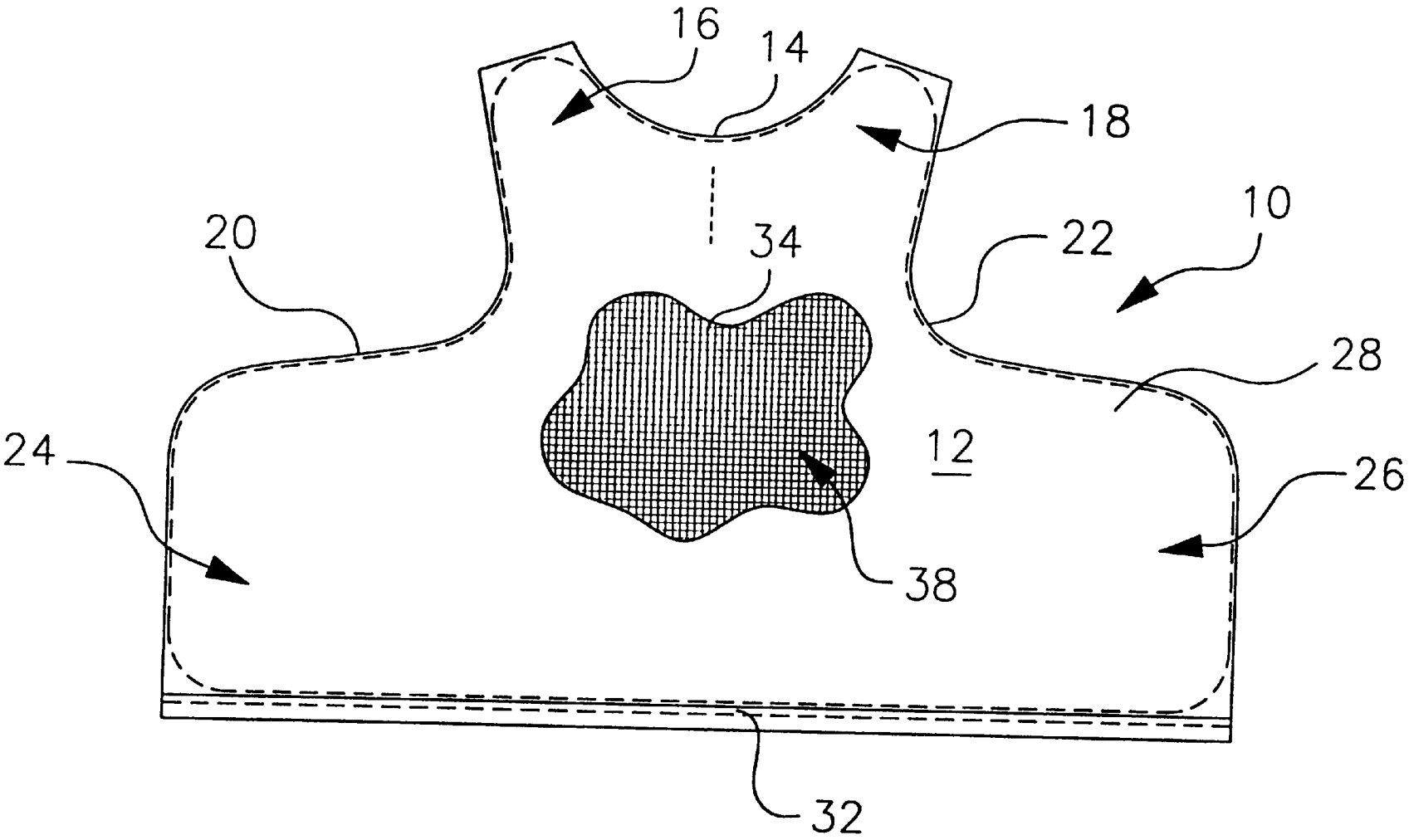
FIG. 1 is a front elevational view, partly broken away, showing a ballistic resistant composite panel used in a ballistic vest according to the principles of this invention.

FIG. 1. illustrates a composite front ballistic panel 10 for a ballistic vest of the soft body armor type commonly worn by law enforcement officers. The composite front ballistic panel 10 provides a protective front section of the vest that overlies the chest region of the user. A separate rear protective region of the vest (not shown) overlies the back of the user. The composite front panel only is depicted in the drawings since the protective back section of the vest has a composite construction substantially identical to the front section. Therefore, the description of the composite front panel to follow will suffice for the rear panel used in the ballistic vest.

The front and rear composite protective panels are preferably carried in a vest structure which is well known in the art. The vest includes front and rear carriers for the front and rear ballistic panels, with shoulder straps and waist straps for securing the vest to the upper torso of the user. A ballistic vest with front and rear carriers that can be used for carrying the front and rear ballistic panels of this invention is described, e.g., in U.S. Pat. No. 4,697,285, which is assigned to the assignee of this application and incorporated herein by this reference.

Referring again to FIG. 1, the composite front ballistic panel 10 is generally configured to include a main body portion 12 that covers the chest region of the user, a recessed upper scoop neck region 14 for fitting under the neck, right and left upper projecting shoulder regions 16 and 18 for covering the right and left shoulders, recessed right and left arm regions 20 and 22 for fitting under the right and left arm of the user, and right and left side regions 24 and 26 for extending along the sides of the user when the panel is placed in a front carrier of the vest and worn over the chest.

Figure 2:
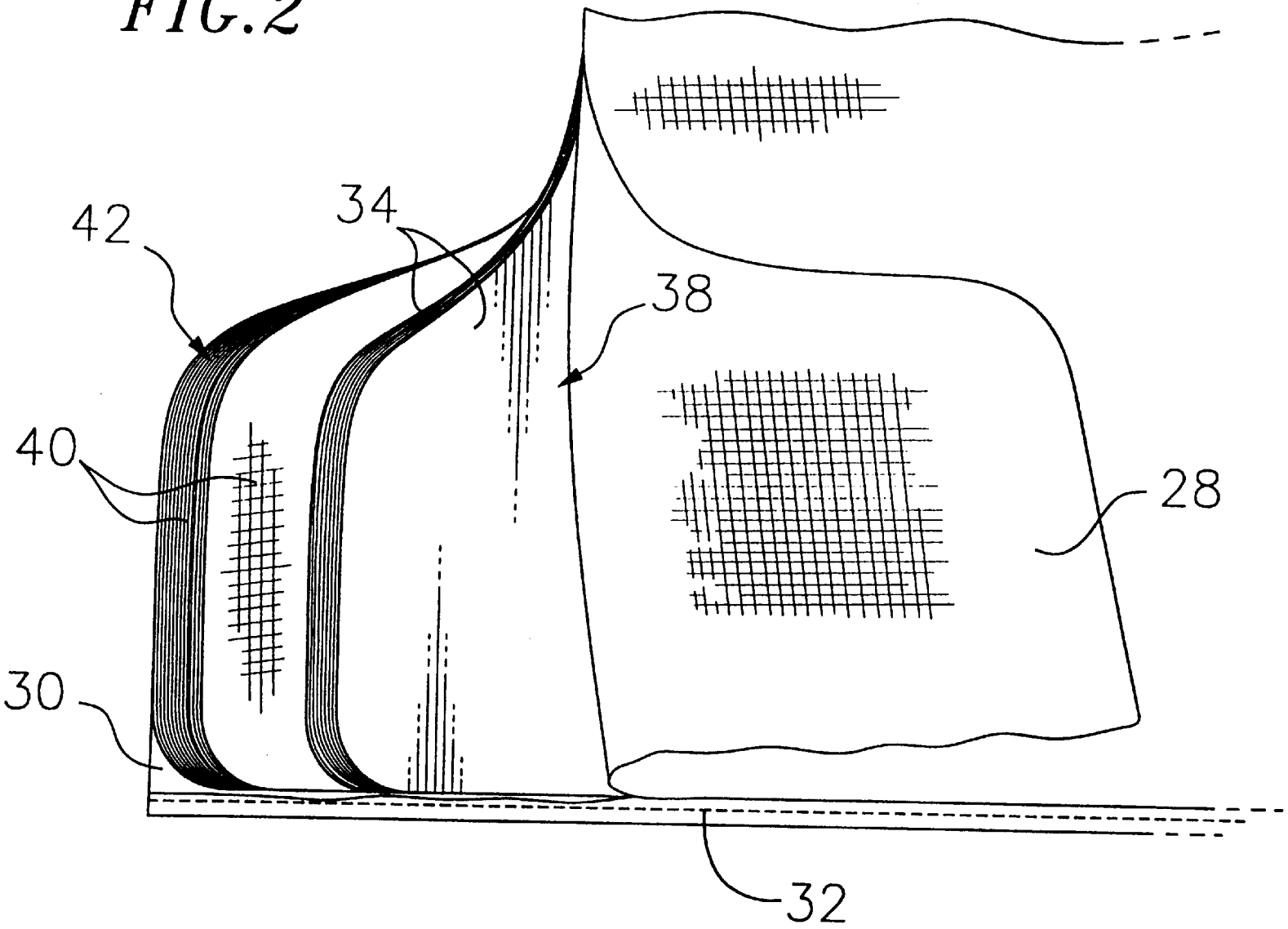
FIG. 2 is a fragmentary perspective view, partly broken away, showing internal components of the ballistic resistant panel of FIG. 1.

Referring to FIGS. 1 and 2, the composite front ballistic panel 10 includes an outer casing 28 made of front and rear sheets of an imperforate flexible waterproof fabric, such as ripstop nylon. The front sheet of the casing is shown at 28 in FIG. 1 and the rear sheet is shown at 30 in FIG. 2. The flexible front and rear sheets are secured together around the perimeter of the front panel 10 by stitching, such as the stitching shown at 32 in FIG. 1, which forms a bottom hem for the casing.

The front ballistic panel further includes a plurality of overlying flexible first ballistic fabric layers 34 arranged in a stack on a strike (front) side of front panel 10. The individual fabric layers together form a front panel section 38 of unitary structure. The composite front ballistic panel 10 also includes a plurality of overlying flexible second ballistic fabric layers 40 arranged in a stack on a body (rear) side of the front panel 10. The first and second layers 34 and 40 are all cut to all the same size and shape and overlie one another in layers parallel to one another. FIG. 2 shows a cut-away view of the front face 28 of the outer casing to reveal the stacks of first and second layers of the composite front ballistic panel 10, the first and second layers are stacked behind the front sheet 28 so they are free-floating, i.e., they are freely movable relative to one another within the casing without being laminated to each other or otherwise bonded to one another in a face-to-face relation. Thus, the individual first and second layers are free floating within an area encompassing most of the surface area occupied by the layers that comprise the front ballistic panel 10. The second layers are stacked together to form in the aggregate what is referred to herein as a rear panel section 42 of the composite front ballistic panel 10.

By way of example, each first flexible layer of ballistic fabric comprises thin plastic ballistic fibers forming a thin, flexible aramid fabric layer. The individual aramid fabric layers include unidirectional aramid fibers coated with resin and cross plied at 90° to form a unidirectional aramid fiber-reinforced thermoplastic film sheet. Each second flexible layer comprises a thin flexible woven fabric layer. The individual woven layers can include aramid or non-aramid fibers, with polyethylene the preferred non-aramid fiber material. Although the invention has been described as including unidirectional aramid fibers as the first layer and aramid or non-aramid woven ballistic fibers as the second flexible layers, it is to be understood that the fiber arrangement of the layers can be reversed depending upon the specific threat encountered. The important aspect of the invention is the hybrid combination of the unidirectional aramid fibers with either aramid or non-aramid woven ballistic fibers and not with the specific arrangement of fibers on the strike or body side of the ballistic panel 10.

The first flexible layers 34 of the front ballistic panel 10 will now be described in more detail. Each first layer 34 preferably comprises a thin, flexible fiber-reinforced plastic film sheet. The film sheets are reinforced with an array of ultra high molecular weight high tensile strength ballistic-resistant polymeric fibers embedded in a thermoplastic resinous matrix film. The preferred reinforcing fibers are a unidirectional (non-woven) aramid ballistic fiber. The term "fiber" is defined herein as an elongated filament-like body of reasonably uniform diameter from end to end with its long dimension substantially greater than the width or thickness of the fiber. The preferred fiber-reinforced thermoplastic sheet is available under the designation Gold Shield (formerly known as Spectramide) manufactured by Allied Signal in which the fibers comprise Akzo/Nobel 1500 denier aramid fiber. The Gold Shield product comprises a fiber bundle of Twaron fibers with a filament count of less than 1.5 denier per filament. The preferred Gold Shield material has an areal density of about 7.87 oz/yd$^2$; the resinous matrix is made from a proprietary thermoplastic elastomer and the finished ballistic fabric has a resin matrix content of 30+ or −3.0%.

Another preferred unidirectional aramid fiber-reinforced thermoplastic sheet is available under the designation Gold Flex also manufactured by Allied Signal, using a proprietary unidirectional fiber/resin process in which the fibers also comprise Akzo/Nobel 1500 denier aramid fiber, with the fabric layer having an areal density of about 7.2 oz/yd$^2$. The thermoplastic resin sheet has a 30+ or −3% resin matrix content. The Gold Flex sheet material is calendared to improve flexibility.

The fiber tenacity of the aramid fibers contained in the Gold Shield and Gold Flex materials is about 20 grams per denier.

The second flexible layers 40 of the front ballistic panel 10 comprise a flexible ballistic fabric made of woven ultra-high molecular weight high strength polymeric fibers which exhibit useful ballistic resistance in the woven form of the fabric. The preferred fabric is a plain woven fabric made of aramid fibers. The preferred aramid fiber used in the woven fabric is available under the designation Twaron 840 manufactured by Akzo/Nobel. Twaron 840 has a fiber tenacity of about 26 grams per denier. The tensile modulus of the fibers, as measured on an Instron tensile machine, is about 500–1000 grams per denier, more preferably above 1000 grams per denier. The areal density of the woven layer is about 200+ or −10 g/m$^2$ and the weave in ends per inch, warp and fill is 27+ or −1. The fabric is constructed in a plain weave.

Another preferred woven fabric for the second flexible layers 40 includes a plain woven ballistic fabric made of uncoated ultra high molecular weight extended chain polyethylene fibers. The fiber material is available from Allied Signal. The woven fabric is available under the designation SPECTRA 2000, 180 denier from various suppliers of woven fabric material. The fibers contained in the fabric have a fiber tenacity of greater than about 20 grams per denier. The tensile modulus of the fibers is about 1000–2000 grams per denier. The total fiber areal density of the fabric does not exceed about 4.0 ounces per square yard. The fabric is constructed in a plain weave with 249 ends per inch in the warp direction and 249 ends per fill direction.

In one embodiment of the invention, the front panel section 38 consists of approximately 9 layers of Gold Flex material, and the rear panel section 42 consists of a woven fabric of approximately 12 layers of Twaron 840 fibers. The Gold Flex layers are attached to the Twaron 840 layers by a single one-inch long vertical bar stitch at the lowest point on the scoop region 14 of the composite ballistic panel. The stitching penetrates and joins all 21 layers of the panel. The woven ballistic fabric layers contained in the second panel are unquilted for enhanced flexibility, although in some embodiments, the fabric layers can be quilted.

The areal weight of the complete ballistic sandwich does not exceed about 1.30 pounds per square foot, more preferably about 1.15 pounds per square foot.

FIG. 4 shows an alternative embodiment of the present invention in which the front ballistic panel further includes a plurality of overlying third flexible fabric layers 50 arranged in a stack on a body (rear) side of the front panel 10. The individual third flexible fabric layers 50 overlie one another to form a third panel section 52 which together with first panel section 38, sandwiches the second panel section 42. In this configuration, the individual flexible layers 50 comprise the same material used for the first individual layers 34. Depending upon the specific threat level, individual layers 34 and 50 can be unidirectional aramid fibers with individual layers 40 being aramid or non-aramid woven fibers, or layers 34 and 50 can be aramid or non-aramid woven fibers with layers 40 comprising unidirectional aramid fibers. In the two-layer embodiment the woven aramid or non-aramid fabric layers can be on the front or strike side of the vest, and the unidirectional aramid shield material can be on the body side of the vest.

The number of individual layers in each panel section 38, 42, and 52, can be varied such that the total areal weight of the ballistic panel 10 does not exceed about 1.30 lbs/ft$^2$ and more preferably about 1.15 lbs/ft$^2$.

EXAMPLE 1

An initial objective was to produce a ballistic vest utilizing unidirectional aramid fiber material coated with a resin and subsequentially cross-plied at 90° angles. In a base line test at 0.75 psf for pure aramid unidirectional fiber material (Spectramide)the test resulted in a V-50 reading for a 9 mm projectile of 1433 ft/sec as compared to a unidirectional polyethylene fiber material (SPECTRA Shield) having a V-50 reading of 1450 ft/sec. Another unidirectional aramid fiber material (SPECTRA Flex) was tested resulting in a V-50 reading of 1517 ft/sec. A polyethylene woven fiber material (SPECTRA 2000, 180 denier) was tested resulting in a V-50 reading of 1465 ft/sec and an aramid woven fabric (Twaron 840) was tested resulting in a V-50 reading of 1462 ft/sec. This test indicated there is nothing ballistically significant in terms of a quantum difference for a ballistic panel including a purely unidirectional aramid fiber material.

Hybrid testing was then performed to evaluate Spectramide unidirectional aramid fabric in various hybrid constructions with SPECTRA 2000, 180 denier woven fabric, Spectra Shield, Spectra Flex and Twaron 840 denier woven fabric. These tests indicated that the hybrid combination of Spectramide and Twaron 840 resulted in improved ballistic data. The 1.0 psf construction of 6 plies of woven Twaron 840, 9 plies of Spectramide, and 6 plies of woven Twaron 840 (front to rear) had a V-50 reading with a 9 mm projectile of 1642 ft/sec. The results were as follows:

SPECTRAMIDE EVALUATION RESULTS

| PANEL | LAYER COUNT | | | | | FABRIC | | | HIGH | LOW |
|---|---|---|---|---|---|---|---|---|---|---|
| 9 mm | 180 | MID | FLEX | SS | 840 | CONFIGURATION | A.D. | V-50 | PART. | COMP. |
| | | | | | | .75 psf w/9 mm | | | | |
| #799 | | 14 | | | | 100% Mid | .77 | 1433 | 1484 | 1394 |
| #799A | | 06 | | 13 | | 6(mid) + 13(shield) | .733 | 1424 | 1434 | 1420 |
| #799B | | 06 | | 13 | | 7(SS) + 6(mid) + 6(SS) | .733 | 1336 | 1374 | 1290 |
| #799C | | 06 | | 13 | | 3(mid) + 13(ss) + 3(mid) | .733 | 1383 | 1400 | 1336 |

-continued

SPECTRAMIDE EVALUATION RESULTS

| PANEL | LAYER COUNT | | | | | FABRIC | | | HIGH | LOW |
|---|---|---|---|---|---|---|---|---|---|---|
| 9 mm | 180 | MID | FLEX | SS | 840 | CONFIGURATION | A.D. | V-50 | PART. | COMP. |
| #799D | | 06 | | | 10 | 6(mid) + 10(840) | .749 | 1465 | 1504 | 1420 |
| #799E | | 06 | | | 10 | 5(840) + 6(mid) + 5(840) | .749 | 1450 | 1468 | 1418 |
| #799F | | 06 | | | 10 | 3(mid) + 10(840) + 3(mid) | .749 | 1359 | 1468 | 1314 |
| #799G | 30 | 05 | | | | 30(180) + 5(mid) | .756 | 1445 | 1442 | 1416 |
| #799H | 30 | 05 | | | | 15(180) + 5(mid) + 5(180) | .756 | 1467 | 1466 | 1456 |
| #799I | 30 | 05 | | | | 3(mid) + 30(180) + 2(mid) | .756 | | | |
| | | | | | | 1.0 psf w/9 mm | | | | |
| #789A | | 18 | | | | 100% Mid | .999 | 1449 | 1436 | 1436 |
| #789D | 43 | 04 | 05 | | | 15,15,13(180)5(flex)4(mid) | 1.06 | 1659 | 1683 | 1636 |
| #789F | 30 | 09 | | | | 15(180) + 9(mid) + 15(180) | .978 | 1577 | 1613 | 1530 |
| #789H | 30 | 09 | | | | 30(180) + 9(mid) | .978 | 1545 | 1594 | 1510 |
| #789I | | 09 | | | 12 | 12(840) + 9(mid) | .999 | 1554 | 1600 | 1504 |
| #789J | | 09 | | | 12 | 6(840) + 9(mid) + 6(840) | .999 | 1642 | 1664 | 1648 |
| | | | | | | 1.0 psf w/.44 Mag | | | | |
| #789C | | | | | 18 | 100% | .999 | 1513 | 1505 | 1524 |
| #789E | 43 | 04 | 05 | | | 15,15,13(180)5(flex)4(mid) | 1.06 | 1650 | 1672 | 1636 |
| #789G | 30 | 09 | | | | 15(180) + 9(mid) + 15(180) | .978 | 1529 | 1518 | 1526 |
| | | | | | | 1.0 psf w/.357 Mag | | | | |
| #789B | | 18 | | | | 100% mid | .999 | 1524 | 1512 | 1534 |

EXAMPLE 2

Further evaluation of the unidirectional aramid products indicated that the hybrid combination of unidirectional aramid fiber material with woven aramid and woven non-aramid fabric produced improved ballistic data. Specifically, the hybrid combination having three panel sections wherein the first panel consisted of five layers of Spectramide, the second layer included 26 layers of SPECTRA 180 denier woven fabric and the third section included 15 layers of Spectramide resulted in a V-50 reading of 1733. The hybrid combination of four layers of Spectramide, 12 layers of Twaron 840 denier woven fabric and 5 layers of Spectramide produced a V-50 reading of 1658. A two-section construction including nine layers of Spectramide and 12 layers of Twaron 840 denier woven fabric produced a V-50 reading of 1668. The test results show good results with a mixture of unidirectional aramid fiber sheets and woven aramid fiber sheets with a majority of the total ballistic package comprised of the woven fabric sheets. A preferred mixture is about 55 to 65% woven aramid fiber sheets and about 35 to 45% unidirectional aramid sheets, the more preferred ranges comprising a 60/40 ratio. The results of this test were as follows:

SPECTRAMIDE EVALUATION RESULTS

| PANEL | LAYER COUNT | | | | | FABRIC | | | HIGH | LOW |
|---|---|---|---|---|---|---|---|---|---|---|
| 9 mm | 180 | MID | FLEX | SS | 840 | CONFIGURATION | A.D. | V-50 | PART. | COMP. |
| | | | | | | .75 psf w/9 mm | | | | |
| #799 | | 14 | | | | 100% Mid | .77 | 1433 | 1484 | 1394 |
| #799A | | 06 | | 13 | | 6(mid) + 13(shield) | .733 | 1424 | 1434 | 1420 |
| #799B | | 06 | | 13 | | 7(SS) + 6(mid) + 6(SS) | .733 | 1336 | 1374 | 1290 |
| #799C | | 06 | | 13 | | 3(mid) + 13(ss) + 3(mid) | .733 | 1383 | 1400 | 1336 |
| #799D | | 06 | | | 10 | 6(mid) + 10(840) | .749 | 1465 | 1504 | 1420 |
| #799E | | 06 | | | 10 | 5(840) + 6(mid) + 5(840) | .749 | 1450 | 1468 | 1418 |
| #799F | | 06 | | | 10 | 3(mid) + 10(840) + 3(mid) | .749 | 1359 | 1468 | 1314 |
| #799G | 30 | 05 | | | | 30(180) + 5(mid) | .756 | 1445 | 1442 | 1416 |
| #799H | 30 | 05 | | | | 15(180) + 5(mid + 5(180) | .756 | 1467 | 1466 | 1456 |
| #799I | 30 | 05 | | | | 3(mid) + 30(180) + 2(mid) | .756 | 1554 | 1600 | 1504 |
| | | | | | | 1.0 psf w/9 mm | | | | |
| #789A | | 18 | | | | 100% Mid | .999 | 1449 | 1436 | 1436 |
| #789D | 43 | 04 | 05 | | | 15,15,13(180)5(flex)4(mid) | 1.06 | 1659 | 1683 | 1636 |
| #789F | 30 | 09 | | | | 15(180) + 9(mid) + 15(180) | .978 | 1577 | 1613 | 1530 |
| #789H | 30 | 09 | | | | 30(180) + 9(mid) | .978 | 1545 | 1594 | 1510 |
| #789N | 26 | 10 | | | | 5(mid) + 26(180) + 15(mid) | .965 | 1733 | 1790 | 1722 |
| #789I | | 09 | | | 12 | 12(840) + 9(mid) | .999 | 1554 | 1600 | 1504 |
| #789J | | 09 | | | 12 | 6(840) + 9(mid) + 6(840) | .999 | 1642 | 1664 | 1648 |

-continued

SPECTRAMIDE EVALUATION RESULTS

| PANEL | LAYER COUNT | | | | | FABRIC | | | HIGH | LOW |
|---|---|---|---|---|---|---|---|---|---|---|
| 9 mm | 180 | MID | FLEX | SS | 840 | CONFIGURATION | A.D. | V-50 | PART. | COMP. |
| #789K | | 09 | | | 12 | 12(840) + 9(mid) | .999 | 1566 | 1571 | 1506 |
| #789K | | 09 | | | 09 | 9(MID) + (840) | .874 | 1633 | 1662 | 1600 |
| #789M | | 09 | | | 13 | 4(mid) + 12(840)+ 5(mid) | .999 | 1658 | 1681 | 1628 |
| #789O | | 09 | | | 12 | 9(mid) + 12(840) | .999 | 1668 | 1670 | 1658 |
| | | | | | | 1.0 psf w/.44 Mag | | | | |
| #789C | | | | | 18 | 100% | .999 | 1513 | 1505 | 1524 |
| #789E | 43 | 04 | 05 | | | 15,15,13(180)5(flex)4(mid) | 1.06 | 1660 | 1672 | 1636 |
| #789G | 30 | 09 | | | | 15(180) + 9(mid) + 15(180) | .978 | 1529 | 1518 | 1526 |
| | | | | | | 1.0 psf w/.357 Mag | | | | |
| #789B | | 18 | | | | 100% mid | .999 | 1524 | 1512 | 1534 |
| | | | | | | .22 Frag. Sim @ .75 psf | | | | |
| #799-1 | | 14 | | | | 100% mid | .77 | 1324 | 1339 | 1321 |
| #799A | | 06 | | 13 | | 6(mid) + 13(shield) | .733 | 1452 | 1460 | 1429 |
| #799B | | 06 | | 13 | | 7(SS) + 6(mid) + 6(SS) | .733 | 1377 | 1384 | 1384 |
| #799C | | 06 | | 13 | | 3(mid) + 13(ss) + 3(mid) | .733 | 1336 | 1357 | 1282 |
| #799D | | 06 | | | 10 | 6(mid) + 10(840) | .749 | 1624 | 1632 | 1608 |
| #799E | | 05 | | | 10 | 5(840) + 6(mid) + 5(840) | .749 | 1476 | 1502 | 1470 |
| #799F | | 06 | | | 10 | 3(mid) + 10(840) + 3(mid) | .749 | 1676 | 1686 | 1671 |
| #799G | 30 | 05 | | | | 30(180) + 5(mid) | .756 | 1631 | 1621 | 1624 |
| #799H | 30 | 05 | | | | 15(180) + 5(mid) + 15(180) | .756 | 1712 | 1748 | 1697 |
| #799I | 30 | 05 | | | | 3(mid) + 30(180) + 2(mid) | .756 | 1681 | 1703 | 1686 |
| | | | | | | Backface Evaluation | | | | |
| | | | | | | @ 1.0 psf w/9 mm | | | | |
| | | | | | | Velocity Range (1350 + 50) | | | | |
| #789A | | 18 | | 12 | | 100% mid | 40 mm | 45 mm | | |
| #789K | | 09 | | 09 | | 12(840) + 9(mid) | 41 mm | 39 mm | | |
| #789L | | 09 | | 12 | | 9(mid) + 9(mid) | 42 mm | 50 mm | 42 mm | |
| #789M | | 09 | | | | 4(mid) + 12(840) + 5(mid) | 43 mm | 46 mm | 46 mm | |
| #789N | 26 | 10 | | 12 | | 5(mid) + 26(1 80) + 5(mid) | 40 mm | 40 mm | 37 mm | |
| #789O | | 09 | | | | 9(mid) + 12(840) | 45 mm | 44 mm | 45 mm | |

EXAMPLE 3

A third test was conducted to evaluate a second unidirectional aramid fiber product known as Gold Flex. This test was conducted on a two-panel construction consisting of unidirectional aramid fiber material and woven aramid fiber material. This test indicated that the hybrid combinations produced statistically significant data over the purely unidirectional aramid fiber material constructions. The test results also verify the improvements achieved with a greater percentage of woven aramid fabric layers than the unidirectional aramid fiber layers. The results of this tests are as follows:

| PANEL | LAYER COUNT | | | | | FABRIC | | | HIGH | LOW |
|---|---|---|---|---|---|---|---|---|---|---|
| 9 mm | 180 | MID | FLEX | SS | 840 | CONFIGURATION | A.D. | V-50 | PART. | COMP. |
| | | | | | | GOLD FLEX EVALUATION RESULTS .75 psf w/9 mm | | | | |
| FMS-2 | | | 15 | | | 100% | .75 | 1480 | 1488 | 1475 |
| | | | | | | 1.0 psf w/9 mm | | | | |
| FMS-3 | | | 20 | | | 100% | 1.0 | 1567 | 1579 | 1563 |
| HB-2 | | | 09 | | 12 | 9(flex) + 12(840) | 1.02 | 1682 | 1758 | 1608 |
| HB-1 | | | 09 | | 12 | 12(840) + 9(fms) | 1.02 | 1616 | 1626 | 1590 |
| | | | | | | 1.0 psf w/.44Mag | | | | |
| FMS-4 | | | 20 | | | 100% | 1.0 | 1556 | 1602 | 1539 |
| | | | | | | 1.0 psf w/.357Mag | | | | |
| FMS-3 | | | 20 | | | 100% | 1.0 | 1530 | 1545 | 1524 |
| | | | | | | .75 psf w/9 mm | | | | |
| PICK-3 | | | 14 | | | 100% | .74 | 1476 | 1482 | 1471 |

-continued

| PANEL | LAYER COUNT | | | | | FABRIC | | | HIGH | LOW |
|---|---|---|---|---|---|---|---|---|---|---|
| 9 mm | 180 | MID | FLEX | SS | 840 | CONFIGURATION | A.D. | V-50 | PART. | COMP. |
| | | | | | | 1.0 psf w/9 mm | | | | |
| PICK-1 | | | 19 | | | 100% | 1.00 | 1600 | 1650 | 1569 |
| PICK-5 | | | 09 | | 12 | 9(flex) + 12(840) | 0.97 | 1642 | 1666 | 1596 |
| | | | | | | 1.0 psf w/.44Mag | | | | |
| PICK-6 | | | 19 | | | 100% | 1.0 | 1487 | 1491 | 1470 |
| | | | | | | 1.0 psf w/.357Mag | | | | |
| PICK-2 | | | 19 | | | 100% | 1.0 | 1555 | 1620 | 1526 |
| | | | | | | .75 psf w/.357Mag | | | | |
| PICK-4 | | | 14 | | | 100% | .74 | 1419 | 1403 | 1422 |
| | | | | | | TEST COMPARISONS BETWEEN SPECTRAMID, & GOLD FLEX .75 psf w/9 mm | | | | |
| #799 | | 14 | | | | 100% Mid | .77 | 1433 | 1484 | 1394 |
| | | 14 | | | | 100% Mid | .77 | 1455 | 1470 | 1430 |
| FMS-2 | | | 15 | | | 100% | .75 | 1480 | 1488 | 1475 |
| PICK-3 | | | 14 | | | 100% | .74 | 1476 | 1482 | 1471 |
| | | | | | | 1.0 psf w/9 mm | | | | |
| #789A | | 18 | | | | 100% Mid | .999 | 1449 | 1436 | 1436 |
| | | 18 | | | | 100% Mid | .99 | 1661 | 1688 | 1653 |
| FMS-3 | | | 20 | | | 100% | 1.00 | 1567 | 1579 | 1563 |
| PICK-1 | | | 19 | | | 100% | 1.00 | 1600 | 1650 | 1569 |
| #7890 | | 09 | | | 12 | 9(mid) + 12(840) | .999 | 1668 | 1670 | 1658 |
| | | 09 | | | 12 | 9(mid) + 12(840) | .99 | 1747 | 1761 | 1708 |
| HB-2 | | | 09 | | 12 | 9(mid) + 12(840) | 1.02 | 1682 | 1758 | 1608 |
| PICK-5 | | | 09 | | 12 | 9(mid) + 12(840) | .97 | 1642 | 1666 | 1596 |
| #789I | | 09 | | | 12 | 12(840) + 9(mid) | .999 | 1554 | 1600 | 1504 |
| | | 09 | | | 12 | 12(840) + 9(mid) | .99 | 1618 | 1626 | 1579 |
| HB-1 | | 09 | | | 12 | 12(840) + 9(mid) | 1.02 | 1616 | 1626 | 1590 |
| | | | | | | 1.0 psf w/.44Mag | | | | |
| #789C | | | | | 18 | 100% mid | .999 | 1513 | 1505 | 1524 |
| | | 18 | | | | 100% mid | .999 | 1591 | 1612 | 1566 |
| FMS-4 | | | 20 | | | 100% | 1.0 | 1556 | 1602 | 1539 |
| PICK-6 | | | 19 | | | 100% | 1.0 | 1487 | 1491 | 1470 |
| | | | | | | 1.0 psf w/.357Mag | | | | |
| #789B | | 18 | | | | 100% mid | .999 | 1524 | 1512 | 1584 |
| | | 18 | | | | 100% mid | .99 | 1634 | 1632 | 1620 |
| FMS-3 | | | 20 | | | 100% | 1.0 | 1530 | 1545 | 1524 |
| PICK-2 | | | 19 | | | 100% | 1.0 | 1555 | 1620 | 1526 |

What is claimed is:

1. A ballistic vest of the soft body armor type comprising a ballistic package having a plurality of overlying first flexible layers arranged in a stack on a strike side of the vest, a plurality of overlying second flexible layers arranged in a stack towards a body side of the vest and a plurality of overlying third flexible layers arranged in a stack on a body side of the vest, wherein the first flexible layer and third flexible layer sandwiches the second flexible layers;

each first flexible layer comprising unidirectional high performance ballistic-resistant aramid fibers coated with resin and cross-plied forming a thin, flexible ballistic-resistant plastic sheet;

each second flexible layer comprising high performance ballistic-resistant polymeric fibers forming a flexible woven ballistic-resistant fabric sheet;

each third flexible layer comprising unidirectional high performance ballistic resistant aramid fibers coated with resin and cross plied forming a thin flexible ballistic resistant plastic sheet;

the stacks of first, second and third flexible layers having a combined areal weight not greater than about 1.30 lbs/ft$^2$ and having an NIJ Standard maximum backface of about 44 mm, with a ballistics resistance that prevents projectile penetration of the combined stacks of first and second flexible layers according to NIJ Standard 0101.03 for Threat Level IIIA.

2. The ballistic vest of claim 1 wherein the ballistic-resistant plastic fibers in the second layers are made of extended chain polyethylene fibers.

3. The ballistic vest of claim 1 wherein the ballistic-resistant plastic fibers in the second layers are made of aramid fibers.

4. The ballistic vest according to claim 1 in which the ballistic package has a combined areal weight less than about 1.15 psf.

5. A ballistic vest of the soft body armor type comprising a ballistic package having a plurality of overlying first flexible layers arranged in a stack on a strike side of the vest, a plurality of overlying second flexible layers arranged towards a stack on a body side of the vest and a plurality of overlying third flexible layers arranged in a stack on a body side of the vest, wherein the first flexible layer and third flexible layer sandwiches the second flexible layers;

each first flexible layer comprising unidirectional high performance ballistic-resistant aramid fibers coated with resin and cross-plied forming a thin, flexible ballistic-resistant plastic sheet;

each second flexible layer comprising high performance ballistic-resistant polymeric fibers forming a flexible woven ballistic-resistant fabric sheet;

each third flexible layer comprising unidirectional high performance ballistic resistant aramid fibers coated with resin and cross plied forming a thin flexible ballistic resistant plastic sheet;

the stacks of first, second and third flexible layers having a combined areal weight not greater that about 1.25 $lbs/ft^2$ and having an NIJ Standard maximum backface of about 44 mm, with a ballistics resistance that prevents projectile penetration of the combined stacks of first and second flexible layers according to NIJ Standard 0101.03 for Threat Level II.

6. The ballistic vest of claim 5 wherein the ballistic-resistant plastic fibers in the second layers are made of extended chain polyethylene fibers.

7. The ballistic vest of claim 5 wherein the ballistic-resistant plastic fibers of the second layers are made of aramid fibers.

8. The ballistic vest of claim 5 wherein the ballistic-resistant plastic fibers of the second layers are made of arramed fibers.

9. The ballistic vest according to claim 5 in which the ballistic package has a combined areal weight less than about 1.15 psf.

10. A ballistic vest of the soft body armor type comprising a ballistic package having a plurality of overlying first flexible layers arranged in a stack on a strike side of the vest, a plurality of overlying second flexible layers arranged towards a stack on a body side of the vest and a plurality of overlying third flexible layers arranged in a stack on a body side of the vest, wherein the first flexible layer and third flexible layer sandwiches the second flexible layers;

each first flexible layer comprising unidirectional high performance ballistic-resistant aramid fibers coated with resin and cross-plied forming a thin, flexible ballistic-resistant plastic sheet;

each second flexible layer comprising high performance ballistic-resistant polymeric fibers forming a flexible woven ballistic-resistant fabric sheet;

each third flexible layer comprising unidirectional high performance ballistic resistant aramid fibers coated with resin and cross plied forming a thin flexible ballistic resistant plastic sheet;

the stacks of first, second and third flexible layers having a combined areal weight not greater than about 1.0 $lb/ft^2$ and having an NIJ Standard maximum backface of about 44 mm, with a ballistics resistance that prevents projectile penetration of the combined stacks of first and second flexible layers according to NIJ Standard 0101.03 for Threat Level IIA.

11. The ballistic vest of claim 10 wherein the ballistic-resistant plastic fibers in the second layers are made of extended chain polyethylene fibers.

12. The ballistic vest of claim 10 wherein the ballistic-resistant plastic fibers of the second layers are made of aramid fibers.

13. The ballistic vest of claim 10 wherein the ballistic-resistant plastic fibers of the second layers are made of aramid fibers.

* * * * *

UNITED STATES PATENT AND TRADEMARK OFFICE

CERTIFICATE OF CORRECTION

Figure 3:
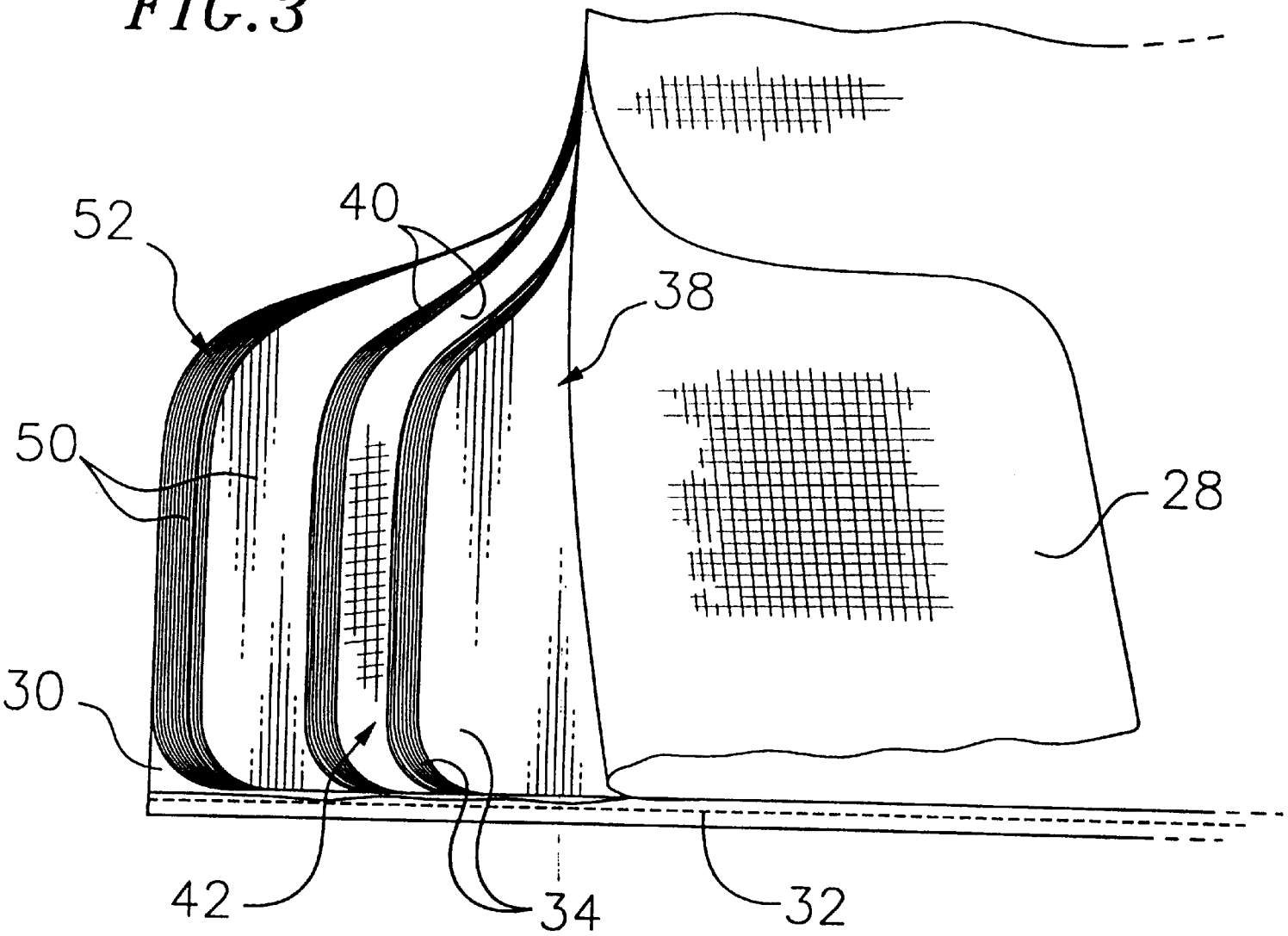
FIG. 3 is a fragmentary perspective view, partly broken away, showing internal components of an alternative ballistic resistant panel of FIG. 1 incorporating three sections of individual layers.

PATENT NO. : 5,926,842
DATED : July 27, 1999
INVENTOR(S) : Allen L. Price; Steven A. Young It is certified that error appears in the above-identified patent and that said Letters Patent is hereby corrected as shown below:

Column 6, line 1, replace "FIG. 4" with --FIG. 3 --.
Column 8, line 55, in the column titled "CONFIGURATION" across from "#799H" replace "15(180) + 5(mid + 5(180)" with --15(180) + 5(mid) + 5(180)--.
Column 9, line 25, in the column titled "MID" across from "#799E" replace "05" with --06--.
Columns 9,10, in the column titled "CONFIRURATION" across from "#789N" replace "5(mid) + 26(1 80) + 5(mid)" with --5(mid) + 26(180) + 5(mid)--.
Column 13, line 27, replace "arramed" with old claim 27, line 3 --aramid--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*